United States Patent [19]

Gringarten

[11] 4,328,705

[45] May 11, 1982

[54] METHOD OF DETERMINING CHARACTERISTICS OF A FLUID PRODUCING UNDERGROUND FORMATION

[75] Inventor: Alain C. Gringarten, Melun, France

[73] Assignee: Schlumberger Technology Corporation, Houston, Tex.

[21] Appl. No.: 177,040

[22] Filed: Aug. 11, 1980

[51] Int. Cl.[3] ..... E21B 49/00

[52] U.S. Cl. ..... 73/155

[58] Field of Search ..... 73/155, 151; 166/250

[56] References Cited

U.S. PATENT DOCUMENTS 3,636,762 1/1972 Kuo et al. ..... 73/155

OTHER PUBLICATIONS

Agarwal, R. G. et al., An Investigation of Wellbore . . . Treatment, Society of Petroleum Engineers Journal, Sep. '70, pp. 279–290.

Earlougher, Jr. R. C. et al. Analysis of Short-Time . . . Matching, from Journal of Petroleum Technology, Jul. '74, pp. 793–800.

McKinley, R. M. Wellbore Transmissibility . . . Buildup Data, from Journal of Petroleum Technology, Jul. '71, pp. 863–872.

*Primary Examiner*—Jerry W. Myracle

[57] ABSTRACT

A graphical plot of pressure versus time during pressure build-up in a temporarily closed well is matched to a type-curve on a graph of such curves to determine if the well is fractured, acidified, fissured or damaged.

8 Claims, 2 Drawing Figures

METHOD OF DETERMINING CHARACTERISTICS OF A FLUID PRODUCING UNDERGROUND FORMATION

FIELD OF THE INVENTION

This invention lies in the field of well test analysis, in order to determine physical characteristics of an underground formation producing a fluid through a borehole. More specifically, the invention concerns a method according to which the borehole is shut in or opened so as to respectively stop or start the flow of fluid in the borehole, and the variations of pressure versus the time intervals elapsed from the beginning of the test are measured and recorded. From these experimental data, the values of several physical parameters characteristic of the underground formation can be derived.

DESCRIPTION OF THE PRIOR ART

Well tests are analyzed by comparing the behavior of the actual reservoir, obtained with experimental data, with the behaviors of well-defined theoretical reservoirs, known as "models", assuming the reservoir and the models are subjected to the same conditions. Usually, the variations of pressure versus the time interval characterize the behavior of the reservoir, and the constant withdrawal of fluid (by opening a valve in the wellbore previously shut in) is the same test condition applied to both the actual and theoretical reservoirs. When similar behaviors are obtained, the real and theoretical reservoirs are assumed to be identical on the qualitative as well as quantitative points of view, that is to say, to have the same characteristics.

The characteristics obtained from this comparison depend on the model: the more sophisticated the model, the greater the accuracy and the greater the number of characteristics that can be determined. A basic model is representative of a homogeneous formation with nonpermeable upper and lower boundaries and with an infinite radial extension. The flow in the formation is therefore assumed to be radial.

However, the most commonly used model is more sophisticated: it includes the features of the basic model to which are added inner boundary conditions such as a skin effect and a wellbore storage effect. The skin effect is defined as a coefficient S characterizing the alteration or the stimulation of the formation near the wellbore. The wellbore storage effect is defined as the difference in production rate between the formation and the wellhead when the valve at the wellhead is either closed or open.

The behavior of a theoretical model is tangibly represented by a graph of "type-curves" which represent the pressure behavior of a theoretical reservoir with specific features, such as wellbore storage, skin, fractures, etc. They are usually graphed on log-log paper, as a dimensionless pressure versus a dimensionless time, each curve being characterized by a dimensionless number that depends upon the specific reservoir model. Dimensionless parameters are defined as the real parameter times a coefficient that includes reservoir characteristics, so that when the appropriate model is being used, real and theoretical pressure versus time curves are identical in shape but displaced one with respect to the other, when plotted on identical log-log graphs, with the displacement factors for both pressure and time axes being proportional to some reservoir parameters. Therefore, plotting real data as log-log pressure change versus elapsed time curves provides qualitative as well as quantitative information on the reservoir.

Qualitative information on the reservoir, such as for example the presence of a fracture, is obtained by identifying the various flow regimes on a log-log plot of all test data. Knowing that a particular feature of a reservoir, such as a vertical fracture for example, is characterized by a specific flow regime, all the various flow regimes displayed on the log-log plot of all test data are analyzed to identify the corresponding features of the reservoir. This is achieved with the help of specialized plots.

Once these features are recognized, a theoretical model including these features is selected, i.e. a specific graph of type-curves is chosen. Quantitative information is then obtained by selecting one type-curve having the same shape as the experimental log-log plot and by determining the shift of the axes of the theoretical and experimental curves, one with respect to the other.

The most commonly used model is related to a reservoir with wellbore storage and skin effects. However, to a given model there correspond several graphs of type-curves. This depends on the dimensionless parameters chosen for the axes of the graph and on the curve label (which is another parameter chosen for representing the curves, in addition to the dimensionless parameters of the axes).

An example is given in the article entitled "An Investigation of Wellbore Storage and Skin Effect in Unsteady Liquid Flow: Analytical Treatment" published by R. G. Agarwal et al, in Society of Petroleum Engineer Journal, September 1970, page 279. The type-curves shown in this article are the dimensionless pressure $p_D$, on the y-axis, plotted versus a dimensionless time $t_D$, on the x-axis. Each curve corresponds to a specific value of the skin S and the dimensionless wellbore storage parameter $C_D$. Efficient use of this graph requires $C_D$ to be known for the well of interest. If this is not the case, matching of the experimental curve with one of the type-curves becomes rather difficult, because different ($C_D$'S) curves have similar shapes.

A second example of type-curves is given in an article entitled "Analysis of Short-Time Transient Test Data by Type-Curve Matching" published by R. C. Earlougher et al in the Journal of Petroleum Technology July 1974, page 793. However, the graph given in this article is valid only for damaged wells and, as a consequence, cannot be used for undamaged, acidized and fractured wells. Moreover, its use is not very convenient due to the fact that the ratio $\Delta p/\Delta t$ is represented on the y-axis. This implies that the experimental variations of pressure $\Delta p$ must be divided by the corresponding time intervals $\Delta t$. A discussion of the prior art and a comparison between the present invention and the prior art are given in the article "A Comparison Between Different Skin and Wellbore Storage Type-Curves for Early-Time Transient Analysis" by A. C. Gringarten et al, published by Society of Petroleum Engineers of AIME, No. SPE 8205.

SUMMARY OF THE INVENTION

Before putting a well into production, a common practice is to make some measurements in order to determine the characteristics of the producing zone. This preliminary step before production is very important since it helps to define the most suitable conditions for producing the reservior fluid, and to determine an appropriate treatment to the well for improving its production capacity. One of these measurements is the survey of pressure variations of the fluid in the wellbore versus time. By closing the well, the "build-up" of pressure is obtained by recording the pressure variations beneath the closure location of the well. Conversely, by opening the well, the "drawdown" of pressure can be recorded.

The variations of pressure versus time can be scrutinized by a logging sonde suspended at one extremity of a cable in the borehole of the well to be tested. The cable can be an electrical cable for transmitting pressure data directly to a recorder located at the surface. Another solution is to use a non-conductive wireline instead, the pressure variations being then recorded downhole within a recording section of the logging sonde. A further alternative is to install by wireline a retrievable pressure gauge in the pocket of a sidepocket mandrel located in the tubing of the well in the proximity of the producing formation. A conductor cable located in the annulus between the tubing and the casing connects the output of the gauge to the recording equipment at the surface. Such a device is described, for example, in U.S. Pat. Nos. 3,939,705 and 4,105,279.

To shut in or open the wellbore, a valve is installed in the tubing, preferably in the proximity of the producing zone but above the pressure gauge, to be able to record the "build-up". Valves suitable for that purpose are well known in the oil industry.

According to the present invention, after the valve is operated to change the fluid flowrate from the underground formation, the subsequent variations in fluid pressure $\Delta p$ versus time change $\Delta t$ are plotted as a curve in log-log axes on an experimental graph. Next the experimental graph curve is matched to one of a series of type-curves on a type-curve graph having the same scale or size. One axis of the type-curve graph represents the pressure change times the product permeability-thickness of a formation ($\Delta p \cdot kh$). The other axis represents the time change times the ratio of the product permeability-thickness to the wellbore storage constant $$\left(\Delta t \cdot \frac{kh}{C}\right).$$

The series of type-curves represents curves having values proportional to $Ce^{2S}$, where C is the wellbore storage constant and S the skin value. Preferably, the curves are drawn for $C_De^{2S}$ where $C_D$ is the dimensionless wellbore storage parameter.

To match the curves, the experimental graph must be displaced along both axes, and these displacements provide for determining certain characteristics of the formation, such as the product permeability thickness, the wellbore storage constant, and the skin value. Similarly, the value of $C_De^{2S}$ for the matched type-curve indicates whether the formation is fractured, acidified, damaged, or (along with the values of C and S) fissured.

An object of this invention is to provide a method for analyzing wells under conditions which made the analysis impossible with the methods of the prior art, and particularly for determining physical parameters characteristic of a fluid producing underground formation having a wellbore storage effect.

A further object of this invention is to provide a method for determining if the tested well is damaged, undamaged, and stimulated or communicates with a fracture (either hydraulic or natural).

A still further object of this invention is to provide a method for determining physical parameters of a fluid producing underground formation traversed by a wellbore in which variations in fluid flow versus time are plotted as a curve on an experimental graph, the graph is matched to one of a series of type-curves, and the shifts of the axes of the matched type-curve, as well as the parameters of the matched type-curve, are used to determine the product permeability-thickness, the wellbore storage constant, and/or the skin value.

A still further object of this invention is to provide a graph for determining physical characteristics and values of physical parameters of reservoirs with a wellbore storage effect; the physical characteristics being damage or no damage to the formation, fracture, fissures, and acidification of the formation; and the physical parameters being the wellbore storage constant, the skin constant, and the permeability-thickness product.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
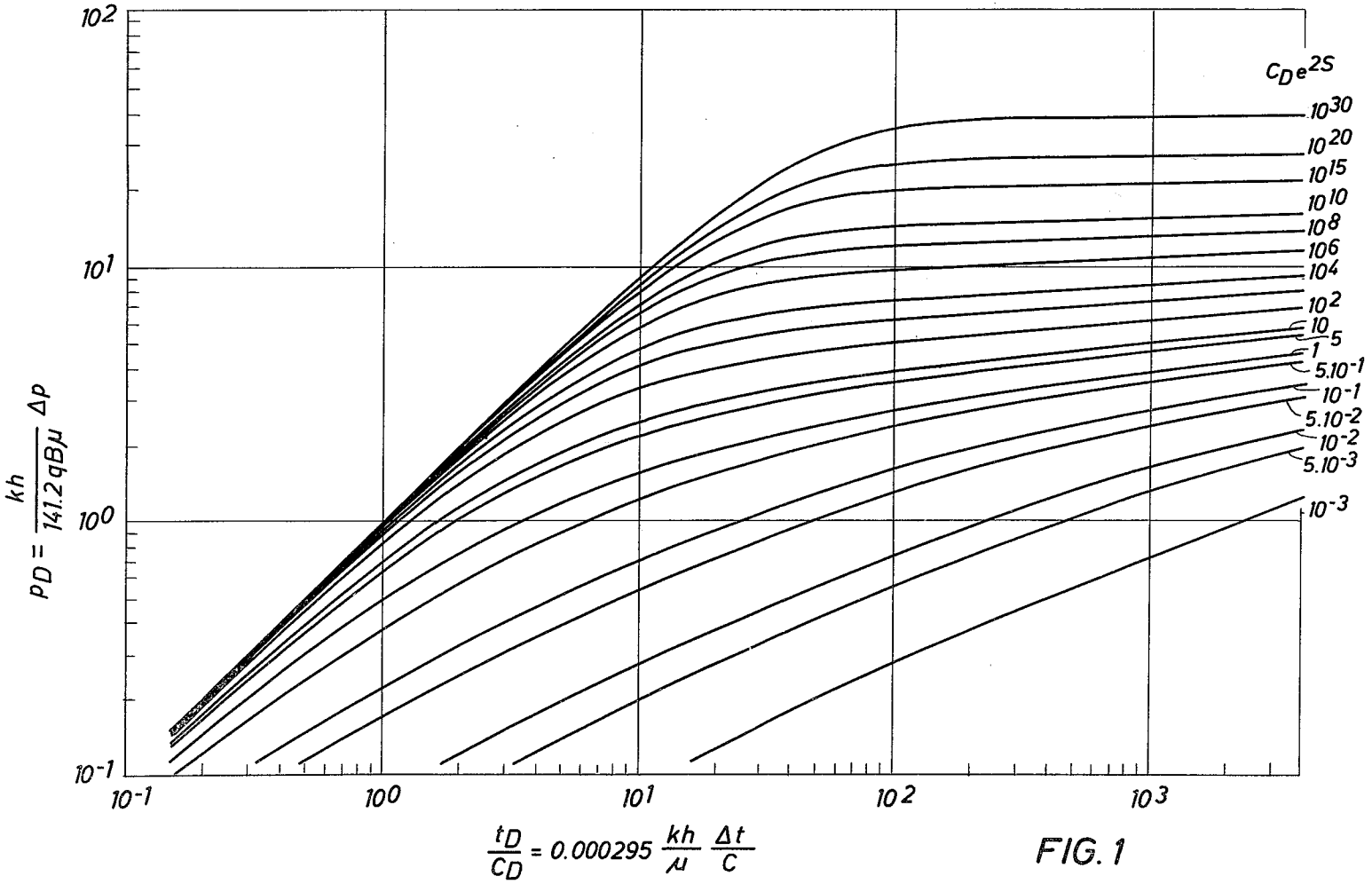
FIG. 1 represents the new graph of type-curves.

Referring to FIG. 1, there is shown the new graph of type-curves which represents the behavior of a reservoir with skin and wellbore storage effects. This graph represents the logarithm of the dimensionless pressure $p_D$, on the y-axis, versus the logarithm of the ratio of the dimensionless time $t_D$ over the dimensionless wellbore storage constant $C_D$, on the x-axis, each curve being characterized by the value of $C_De^{2S}$ (the curve label). The value of $p_D$ is given by the following equation (in U.S. oil field engineering units):

$$p_D = \frac{kh}{141.2\, qB\mu}\,\Delta p \qquad (1)$$

wherein p1 k is the formation permeability, h is the formation thickness, $\Delta p$ is the variation of pressure, q is the flow rate, B is the formation volume factor, and $\mu$ is the viscosity of the fluid.

The value of $$\frac{t_D}{C_D}$$

is given by:

$$\frac{t_D}{C_D} = 0.000295\,\frac{kh}{\mu}\cdot\frac{\Delta t}{C} \qquad (2)$$

wherein $\Delta t$ is the time interval from the beginning of the test and C is the wellbore storage.

Two different theoretical models are used to build the graph of FIG. 1. For the value of $C_De^{2S}$ at least equal to 0.5, the mathematical equation $p_D$ versus $t_D$ representing the behavior of a first model is given in the Laplace domain by:

$$p_D(s) = \frac{1}{s\left[s + \frac{1}{\ln \frac{2}{\gamma\sqrt{s/C_De^{2S}}}}\right]} \quad (3)$$

Inversion into the real time domain is obtained with the help of a numerical Laplace inversion algorithm such as the one described by H. Stehfest, in Communications of the ACM, D-5, Jan. 13, 1970, No. 1, page 47.

However, it has been demonstrated that this equation is not valid for values of $C_De^{2S} < 0.5$ and therefore that the corresponding model is not suitable. As a consequence, a second theoretical model has been used on the same graph for these values less than 0.5. The corresponding equation, with no wellbore storage effect, is equation (26) given in Society of Petroleum Engineers Journal: "Unsteady State Pressure Distributions Created by Well with a Single Infinite Conductivity Vertical Fracture", August 1974, page 353. Wellbore storage is added by superposition of variable flow rates.

The combination of two different theoretical models on the same graph provides for determining the physical characteristic of the formation, i.e. if it is damaged or undamaged, acidized, fissured or fractured. In FIG. 1, damaged wells correspond to $C_De^{2S} > 10^3$, wells with a zero skin value are characterized by values of $C_De^{2S}$ comprised between $10^3$ and 5; acidized wells correspond to values of $C_De^{2S}$ comprised between 5 and 0.5, and fractured wells with wellbore storage are characterized by $C_De^{2S} < 0.5$. Limits are approximate and may vary slightly.

This distinction was not possible with the methods and graphs of the prior art. It was known that a fracture in the well produced a negative value of S, but conversely, a negative value of S could correspond to a fractured well or an acidized well or a fissured well.

Moreover, the present invention, used with the graph, makes possible the determination of S and C as explained hereafter. This allows for distinguishing a fractured well from a well in a fissured formation since, when the value of C is large and the value of S is highly negative, the formation is a fissured one and not a fractured one. As a consequence, it can be seen that the graph of FIG. 1 provides a novel and convenient method of determining the condition of the tested well.

Figure 2:
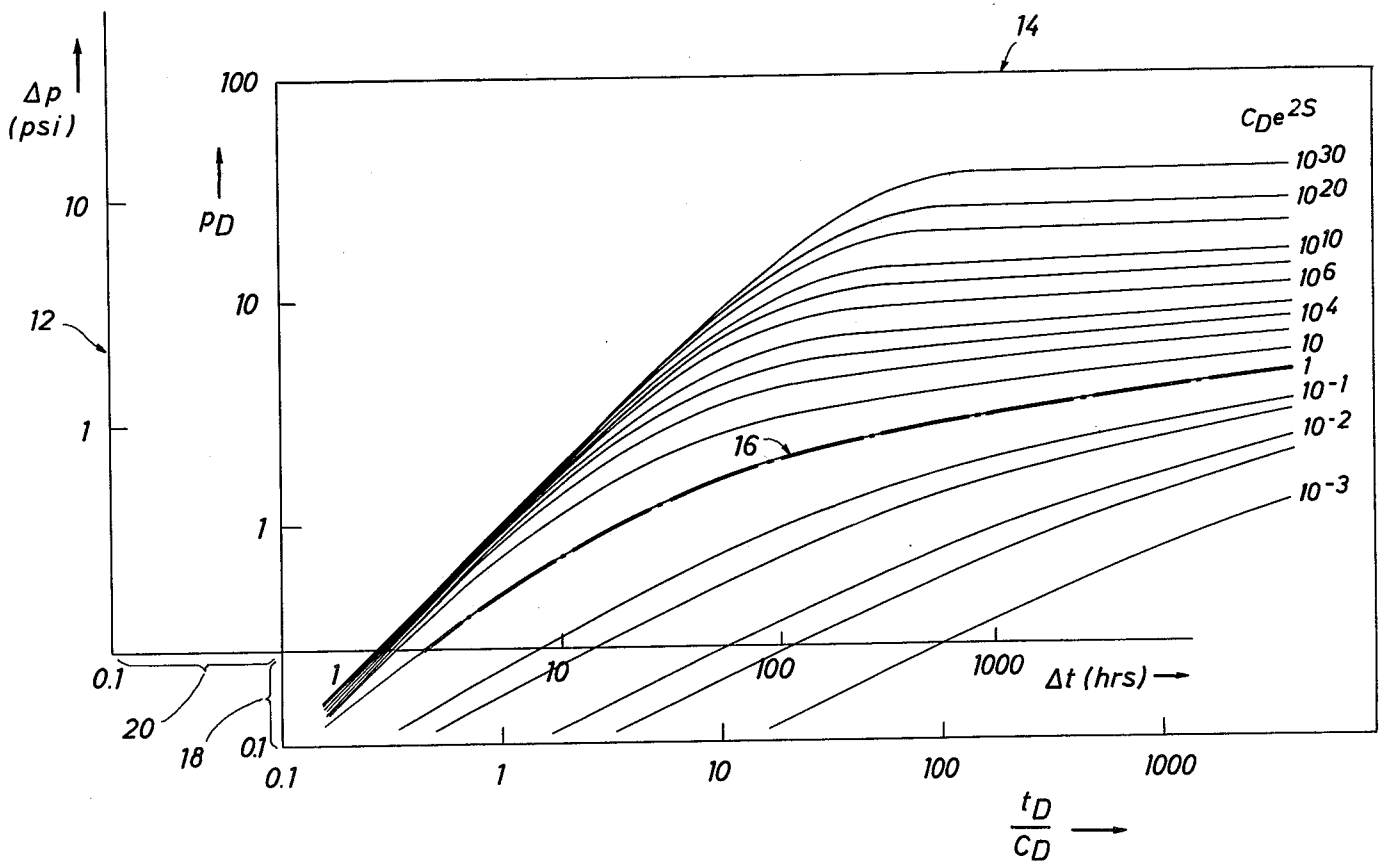
FIG. 2 illustrates the method of the invention for determining characteristics and values of the tested reservoir.

The usual method for using the graph of FIG. 1 is illustrated in FIG. 2. The test data are plotted as $\Delta p$ versus $\Delta t$ on the log-log graph 12. These experimental points are represented by heavy dots on FIG. 2. The experimental graph 12 has the same size as that of the graph of type-curves 14. The experimental curve 16 is translated in directions parallel to the axes of the graph of type-curves until a match of the experimental curve is obtained with one of the type-curves. In FIG. 2, the match is obtained for $C_De^{2S} = 1$.

When wellbore storage is present, matching can be made more conveniently by first overlaying the initial unit slope straight lines on both graphs (experimental and type-curve), and the sliding the experimental graph along this 45° direction until the best match is obtained. This is because wellbore storage yields a log-log straight line of slope unity at early times ($\Delta p$ proportional to $\Delta t$).

Equation (1) can be written under to form:

$$\log p_D = \log \frac{kh}{141.2\, qB\mu} \cdot \Delta p \quad (5)$$

or $$\log p_D = \log \frac{kh}{141.2\, qB\mu} + \log \Delta p$$

It appears from equation (5) that the shift 18 of the experimental curve and the corresponding type-curve, along the y-axis, corresponds to $$\log p_D = \log \Delta p$$

or to $$\log \frac{kh}{141.2\, qB\mu}.$$

The values of the flow rate q are usually known, measurements with a flowmeter or a separator having been made, and the values of the formation volume factor B and of the viscosity $\mu$ of the fluid are determined by analyzing fluid samples (usually called "PVT analysis"). As a consequence, the value of the product permeability-thickness kh can be determined by measuring the shift 18 in FIG. 2.

In the same manner, equation (2) can be written:

$$\log \frac{t_D}{C_D} = \log 0.000295 \frac{kh}{\mu C} + \log \Delta t \quad (6)$$

From this equation (6), one realizes that the shift between the experimental curve and the corresponding type-curve is equal to $$\log \frac{t_D}{C_D} - \log \Delta t,$$

that is to say, equal to $$\log 0.000295 \frac{kh}{\mu C}.$$

The value of the viscosity $\mu$ is supposed to be known and the value of kh has been determined as explained previously. As a consequence, the determination of the wellbore storage C is obtained by measuring the shift 20 in FIG. 2, on the x-axis, between the experimental curve and the corresponding type-curve, said shift 20 being equal to $$\log 0.000295 \frac{kh}{\mu C}.$$

The skin factor S is determined by the match of one type-curve with the experimental curve, said match leading to the value of $C_De^{2S}$.

The value of $C_D$ is determined from the value of C with the following equation:

$$C_D = \frac{0.8926\, C}{\phi\, C_t h r_\omega^2} \quad (7)$$

wherein ($\phi C_t h$) is the storativity-compressability product, known for the geology (such as by core or log analysis) and $r_\omega$ is the wellbore radius. The skin factor S can thereafter be computed from the value of $C_D e^{2S}$.

It is important to notice that, not only does the graph of FIG. 1 make possible the distinction between a damaged formation and an acidized formation, or between a fractured formation and a damaged or acidized formation, but the determination of the value of the wellbore storage constant can be determined in every condition, even if the well is fractured. This was not possible with the graphs of the prior art.

The graph of FIG. 1 has been established assuming that the experimental curve is obtained during the drawdown of the well. However, it has been demonstrated that the graph can also be used during a build-up period, under a certain condition described in the above-mentioned Gringarten et al article. Briefly, this condition is that the ratio $\Delta t/t_p$ should not be larger than a certain value $t_p$ being the sum of the preceding time intervals during which the well has produced.

It can be noticed in FIG. 1 that all type-curves (except for small values of $C_D e^{2S}$) merge into a single unit straight line at early times, when wellbore storage effects dominate. This feature makes easier the match with the experimental curve.

From the foregoing it may be seen that an improved method for the determination of the conditions of a well (damaged, undamaged, acidized, fractured, fissured) and the determination of the values of physical parameters (skin, wellbore storage, product permeability-thickness kh) has been provided. A new graph of type-curves has also been provided for performing the method.

The foregoing disclosure and description of the invention are illustrative and explanatory thereof and various changes, such as for example the number and the size of the type-curves of FIG. 1, may be made within the scope of the appended claims without departing from the spirit of the invention.

What is claimed is:

1. A method for determining physical parameters of a fluid producing underground formation traversed by a wellbore comprising:

changing the fluid flowrate from the formation, plotting the subsequent variations in fluid pressure versus time change as a curve in log-log axes on an experimental graph, matching the curve on the experimental graph to one of a series of type-curves representing, on one axis, the pressure change times the product permeability-thickness of a formation, and on the other axis, the time change times the ratio of the product permeability-thickness to the wellbore storage constant, and determining from the matched type-curve and the shifts of the axes between the experimental graph and the axes of the matched type-curve at least one of the following values of the fluid producing underground formation: the product permeability-thickness, the wellbore storage constant, and the skin value.

2. The method of claim 1 wherein said matching step further comprises matching the curve on the experimental graph to one of a series of type-curves wherein each type-curve represents a value proportional to $Ce^{2S}$, C being the wellbore storage constant and S the skin value.

3. The method of claim 1, wherein the value proportional to $Ce^{2S}$ is $C_D e^{2S}$, $C_D$ being the dimensionless wellbore storage, said graph of type-curves being produced for values of $C_D e^{2S}$ greater than and less than substantially 0.5.

4. The method of claim 3 further comprising determining that the formation is a fractured formation if the maximum value of $C_D e^{2S}$ is equal to substantially 0.5.

5. The method of claim 3 further comprising determining that the formation is an acidified formation if the value of $C_D e^{2S}$ is between substantially 0.5 and 5.

6. The method of claim 3 further comprising determining that the formation is a fissured formation if the value of $C_D e^{2S}$ is less than substantially 0.5, the value of C is greater than approximately 0.1, and the value of S is negative.

7. The method of claim 3 further comprising determining that the formation is a damaged formation if the value of $C_D e^{2S}$ is greater than 1000.

8. A method for determining the condition of a fluid producing underground formation traversed by a wellbore comprising:

changing the fluid flowrate of the well, plotting the subsequent variations in fluid pressure versus time change as a curve in log-log axes on an experimental graph, matching the experimental graph with one of a series of type-curves, of the same size as the experimental graph, the type-curves representing with an additive constant the logarithm of p·kh in one axis and the logarithm of $$\Delta t \cdot \frac{kh}{C}$$

on the other axis, each type-curve representing a value proportional to $C_D e^{2S}$, p being the fluid pressure, t being the time, kh being the product permeability-thickness of the formation, C the wellbore storage constant and S the skin value, the graph of type-curves being produced for values of $C_D e^{2S}$ at least comprised between 0.5 and 1000, and determining that the formation is fractured if the value of $C_D e^{2S}$ represented by the matched type-curve is less than 0.5, that the formation has been acidized if this value is between 0.5 and 5 and that the formation is damaged if this value is greater than 1000.

* * * * *

UNITED STATES PATENT AND TRADEMARK OFFICE

CERTIFICATE OF CORRECTION

PATENT NO. : 4,328,705

DATED : May 11, 1982

INVENTOR(S) : Alain C. Gringarten

It is certified that error appears in the above-identified patent and that said Letters Patent is hereby corrected as shown below:

col. 6, line 16 "log $p_D$=log $\Delta p$" should read --log $p_D$-log $\Delta p$--.

col. 4, line 50 "wherein pl k is the formation permeability" should read -- wherein k is the formation permeability--.

Signed and Sealed this

*Sixteenth* Day of *October 1984*

[SEAL]

*Attest:*

GERALD J. MOSSINGHOFF

*Attesting Officer*

*Commissioner of Patents and Trademarks*